US007389829B2

(12) United States Patent
Dimitroff

(10) Patent No.: US 7,389,829 B2
(45) Date of Patent: Jun. 24, 2008

(54) METHOD AND APPARATUS FOR FORMING BORED HOLE

(76) Inventor: Theodore Roy Dimitroff, 7850 E. Highway AB, Columbia, MO (US) 65201

( * ) Notice: Subject to any disclaimer, the term of this patent is extended or adjusted under 35 U.S.C. 154(b) by 0 days.

(21) Appl. No.: 10/517,396

(22) PCT Filed: May 20, 2003

(86) PCT No.: PCT/EP03/05299

§ 371 (c)(1),
(2), (4) Date: Nov. 28, 2004

(87) PCT Pub. No.: WO03/100205

PCT Pub. Date: Dec. 4, 2003

(65) Prior Publication Data

US 2006/0108149 A1 May 25, 2006

(30) Foreign Application Priority Data

May 29, 2002 (GB) ..... 0212379.2

(51) Int. Cl.
*E21D 1/06* (2006.01)

(52) U.S. Cl. ..... 175/53; 175/344; 175/385; 175/406

(58) Field of Classification Search ..... 175/53, 175/385, 344, 107, 406, 61, 62
See application file for complete search history.

(56) References Cited

U.S. PATENT DOCUMENTS

| | | | | |
|---|---|---|---|---|
| 4,091,631 | A * | 5/1978 | Cherrington | 405/184 |
| 5,314,267 | A * | 5/1994 | Osadchuk | 405/184 |
| 5,351,764 | A * | 10/1994 | Cherrington | 175/53 |
| 5,429,198 | A * | 7/1995 | Anderson et al. | 175/230 |
| 5,778,992 | A * | 7/1998 | Fuller | 175/73 |
| 6,206,109 | B1 * | 3/2001 | Monier et al. | 175/53 |
| 6,386,299 | B1 * | 5/2002 | Kato | 175/62 |
| 6,585,062 | B2 * | 7/2003 | Rozendaal et al. | 175/53 |
| 6,668,946 | B2 * | 12/2003 | Rankin et al. | 175/62 |
| 2002/0066598 | A1 * | 6/2002 | Rozendaal et al. | 175/53 |
| 2002/0096362 | A1 * | 7/2002 | Rankin et al. | 175/26 |
| 2005/0034897 | A1 * | 2/2005 | Youan | 175/53 |

* cited by examiner

*Primary Examiner*—William Neuder
*Assistant Examiner*—Nicole Coy
(74) *Attorney, Agent, or Firm*—Wolff Law Offices; Kevin Alan Wolff

(57) ABSTRACT

A method and apparatus for creating a reamed hole below the surface are disclosed. The reaming apparatus is arranged to be connected to one or more boring stems and has an interior section and an exterior section. The interior section is rotatable independently of the exterior section. Reamed holes of various cross-sections can be produced by appropriate selection of the cross-section of the exterior section.

21 Claims, 4 Drawing Sheets

METHOD AND APPARATUS FOR FORMING BORED HOLE

BACKGROUND OF THE INVENTION

The present invention relates generally to a method and apparatus or tool which is used to create a reamed hole for installing a conduit or pipe. The tool and method is well suited for use with directional boring machines, but can be adapted for use with other mechanical devices (such as a push rod machine) that are used to create subsurface excavations for the purpose of installing conduit or pipe.

Often in the past in order to install a new pipe or conduit it has been necessary to excavate from the surface down to the depth of the desired installation and then replace the material that was excavated. This method is often referred to as "open trench excavation" and is not desirable in many locations due to impact to the general public, to pass under obstacles such as roads, environmental concerns and other issues. Devices and tools have been developed in the past by others in order to allow for the installation of underground pipes and conduits without the necessity of open trenching. This method is generally referred to as "trenchless" installation and includes many varied techniques. The primary types of trenchless construction for new pipe and conduit installations involve directional boring machines, push rod machines, pipe ramming devices, auger boring machines, and tunneling methods all known in the art. There are tools and devices known in the utility construction industry for creating reamed holes for the purpose of installing conduits and pipes and, in particular, there are several apparatuses that are used in the directional boring industry. However, no devices are available that embody or use the aspects of the applied for apparatus. The and advantages of the applied for apparatus and method will significantly improve the efficiency and effectiveness of underground utility construction by establishing a better method for creating a trenchless reamed hole for installing pipe and providing a tool for use with the method.

The apparatus and method is best suited for use with directional boring machines, although it may be used with other devices as discussed later. Directional boring machines, in general, utilize a length of drill pipe with at least a small hole passing through longitudinally from one end to the other. Sections of drill pipe are connected and then advanced through the earth in segmental fashion. This segmented connection of drill pipe is called a drill string. Various methods and apparatuses are used to guide the drill pipe into the desired position. Directional boring machines are typically positioned at the surface and advance the drill pipe down to the depth of the desired bore. Often a fluid mixture is passed through the drill string in order to assist in the drilling process. After the initial drill string is in place a hole opening device, typically referred to as a reamer, is attached and used to create a hole that will accept the desired conduit or pipe.

In the past, in general, the primary methods of creating a reamed hole in directional boring applications has been to use a reamer fixedly mounted to the length of drill pipe. The reamer is then, typically, rotated and pulled through the ground. Often an aqueous solution is pumped through the drill string in order to help create a mixture of the existing soil and special added agents that assist in making a slurry that advantageously allows for easier installation of pipe or conduit product. A typical reamer's primary function is often to either chop up the existing soil in the path of the desired bore hole and mix it with the added agents or to compact the existing soil in the path of the desired bore hole. Sometimes reamers are used to combine both compaction and cutting/mixing. Since soil and earth conditions vary greatly, different tools are used and selected based on operator experience and anticipated conditions. Though there are existing tools available, none use a reaming mechanism that incorporates the dual mixing and cutting functions of the applied for apparatus.

Push rod machines incorporate some of the same overall characteristics as directional boring, but typically are placed in an excavation at one end of the desired bore instead of at the surface. Typically a section of pipe is connected in segmental fashion and advanced through the ground. Again, there are various methods to get the rods in the desired place. Often the overall efficiency of the machines and the machine tooling limits the overall length that can be done at one time. The use of push rod machines has diminished in the recent past, but they are still sometimes used and advances in push rod technology, such as ways to ream holes more efficiently, could lead to more prominent use in the future.

The apparatus utilized for practicing the method of installation of conduit or pipe is novel and unique in that it ideally uses either a plurality of stems or a mechanical drive mechanism in conjunction with a single stem to create a much more effective method of both mixing and reaming the soil. This better method and tool therefore decreases the time and increases the efficiency of the installation of conduits and pipe. In addition to these benefits, it is possible to utilize this method and the embodiments of the apparatus to create rectangular, ovoid or even irregularly shaped reamed holes which may be desirable for some installations. There are currently no available apparatuses in the directional boring industry that allow for the creation of other than a generally round reamed hole.

BRIEF SUMMARY OF THE INVENTION

The present invention is an improved apparatus and method of creating a bored hole below the surface of the earth. More specifically it is a method of creating a bored hole using a special backreaming device connected to a directional boring machine or push rod machine or other mechanical drive device. The method includes the use of a tool that incorporates a dual reaming device that is driven either by a plurality of drill stems or by using mechanical means to differentiate torque to drive mechanisms (ideally gears) from a single stem. The stems will ideally be connected to a directional boring machine but can be connected to another drive mechanism.

The apparatus consists of an exterior reaming part and an interior mixing part. In one preferred embodiment of the invention the exterior part of the apparatus is round and the interior portion of the apparatus is made up of a variety of mixing items. In the preferred embodiment, the outer shell of the apparatus can be turned at a lower speed (and generally with greater torque due to being connected to a larger drill pipe string) and the interior can be turned at a faster speed to increase mixing of fluid and soil. Sometimes it may be desirable to turn the exterior portion at a faster rate and the interior portion at a slower rate. This combination of a primary action of outer cutting and inner mixing provides several benefits over conventional reaming. Conventional reamers in general must both cut and mix the soil and fluids and therefore a sacrifice is typically made with respect to either the mixing efficiency of the device, the cutting efficiency of the device or both the mixing and cutting efficiency. The desired apparatus improves both the mixing capability of the reaming device and the cutting capability.

In another embodiment of the invention the interior mixing portion can be turned counter to the exterior shell portion. This, in effect, multiplies the rotational torque applied to the soil in the interior of the shell (by double the amount or more), allowing for better mixing capability and quality.

Another embodiment of the device incorporates different shapes for the outer shell. The preferred exterior shell shapes are round, polygonal and ovoid shaped, though other shapes can be used. The round shape will likely be the most common commercially used shape due to the nature of underground utility installations. The polygonal shape (often rectangular) can be used for utility construction in areas where maximizing the use of the available space is essential, such as in corridors that are extremely congested with other utilities, though there will likely be other uses. In particular a square shape can provide the maximum cross-sectional area for a reamed hole with the smallest bisected distance. This will allow for the installation of the maximum number of separate conduits in the smallest possible space. The ovoid shape, in the general form of egg shaped, is well suited for sewer main installations due to the flow characteristics of the installed pipe, though other uses can be found.

BRIEF DESCRIPTION OF THE DRAWINGS

The preferred embodiment of the present invention is described in detail below with reference to the attached drawings, wherein.

DETAILED DESCRIPTION OF THE INVENTION

Figure 1:
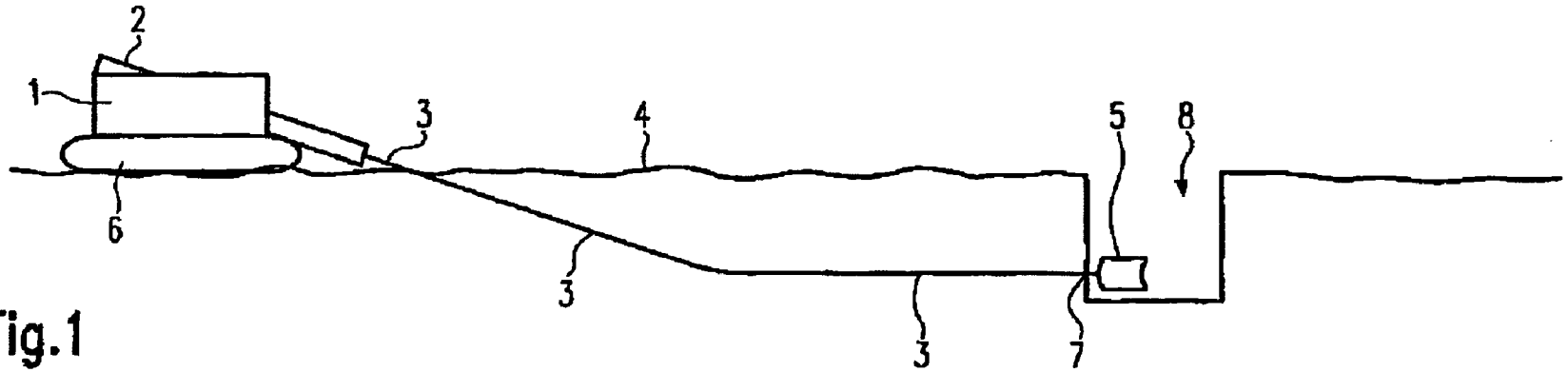
FIG. 1 is a schematic view of a directional machine in a typical application with a set of drill pipe in place.
Figure 2:
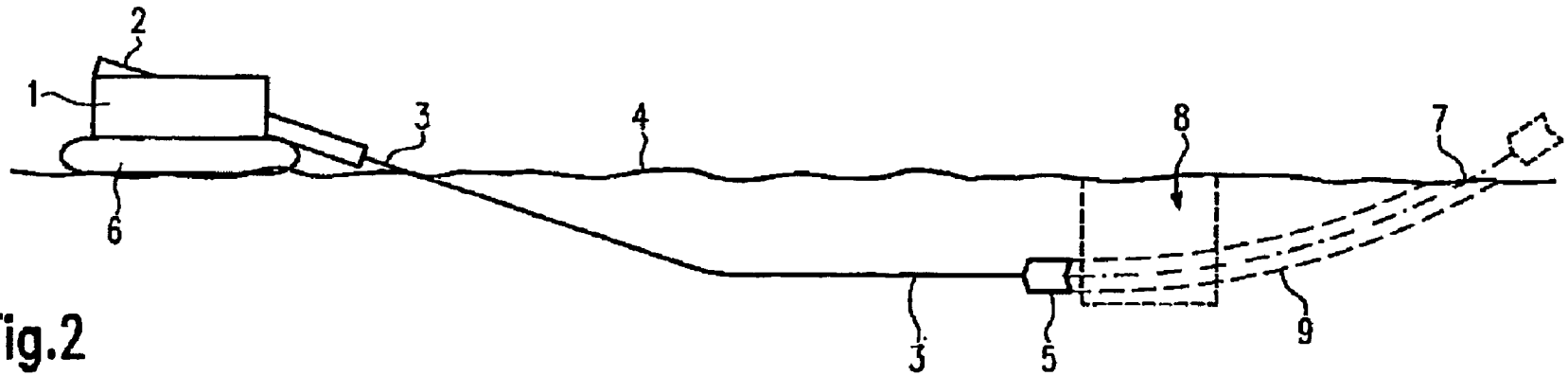
FIG. 2 is a schematic view of the directional boring machine forming a bore hole using the present invention dual reaming apparatus in accordance with the method of the present invention.

Referring to the drawings, and first to FIG. 1 and FIG. 2, the environment in which the apparatus and method is used with a directional boring machine. The boring machine is generally indicated by 1 and shown resting on the earth's surface 4, typically on tracks 6. By using the boring machine 1 the set of drill pipes 3 stored in a drill rack 2 are connected in a segmental fashion and advanced through the ground to a desired point 7. For the purposes of the FIG. 1, this point 7 is shown below the earth's surface 4 in an excavated pit 8. This desired point 7 can be at a point at or near the earth's surface depending on the situation as shown in FIG. 2. The dual reaming apparatus 5 is attached to the drill pipe string 3 and used to create a reamed hole 9 capable of accepting a desired pipe or conduit as shown in FIG. 2.

Figure 3:
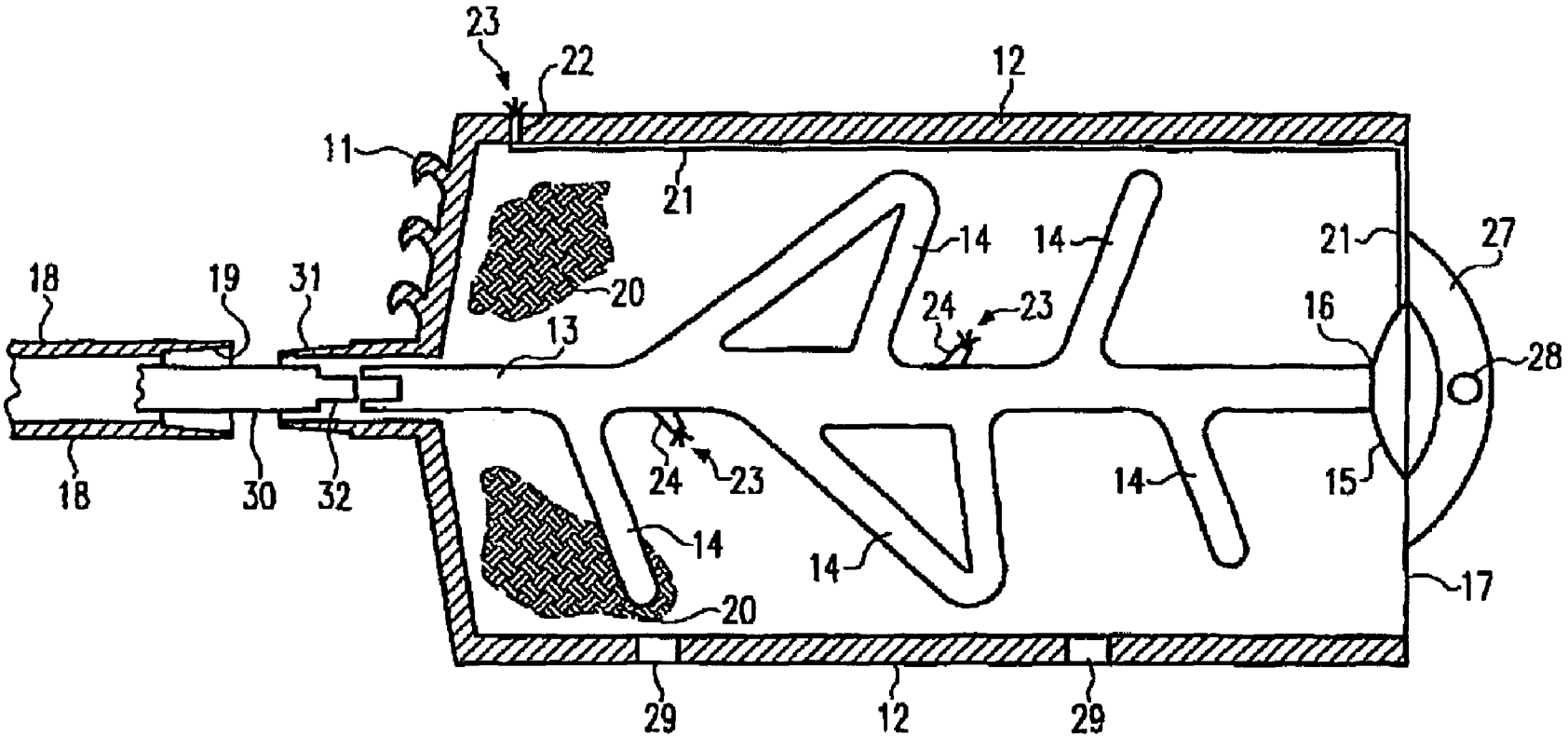
FIG. 3 is an enlarged sectional view of the round shell embodiment of the present invention apparatus connected to a dual stem directional boring machine.

Referring to FIGS. 1, 2 and 3, the boring machine 1 utilizes mechanical and hydraulic energy to turn the drill string 3 and thus the dual reaming apparatus 5. A mixture of aqueous solution is forced down the drill string 3. The dual reaming device 5 is then turned and pulled back through the earth causing the soil in the path of the dual reaming device to be mixed with the fluid being forced down the drill string. The outer shell 12 of the dual mixing device can be turned to cut the existing soil. This cut soil 20 falls into the interior of the outer shell and the inner section of the dual reaming device 13 increases the mixing of the existing soil 20 and fluid 23 that is added through a single or plurality of fluid jet holes 24. The use of a single or plurality of assisting mixing wings 14 of various shapes and lengths extend off of the inner section of the device. The interior mixing device can be connected directly to the interior stem of a dual stem directional boring system and cantilevered without a connection such as that shown in 15 and 16, but problems may arise due to torque and impact of soil and earth material. The preferred embodiment incorporates a connection utilizing a mechanical swivel 16 and sealed bearing assembly 15. This allows the interior mixing portion 13 to turn independently of the outer shell 12 while still providing passive or active support of the interior mixing portion 13.

Added efficiency can be achieved by the addition of multiple fluid jet ports 24 at various locations in order to concentrate the stream of fluid 23 to desired points. A distribution line 21 can be added to direct a portion of fluid 23 directly to an exterior point 22 of the outer shell 12. Fluid lubrication holes 29 may be added to exterior shell 12 as well. Cutting teeth 11 added to the outer shell can add efficiency for the initial cut of the earth for the desired reamed hole. Pipe can be connected to a commercially available swivel and pull head and hooked directly to the reaming device via a plate 27 and connection 28 located at the rear of the device.

Connection of the apparatus to a dual stem directional boring machine can be accomplished by standard methods such as using threaded connections 19 and 31 for the exterior stem and slotted connections for the interior stem 30 or threaded connections for both the exterior and interior stems 32.

Figure 4:
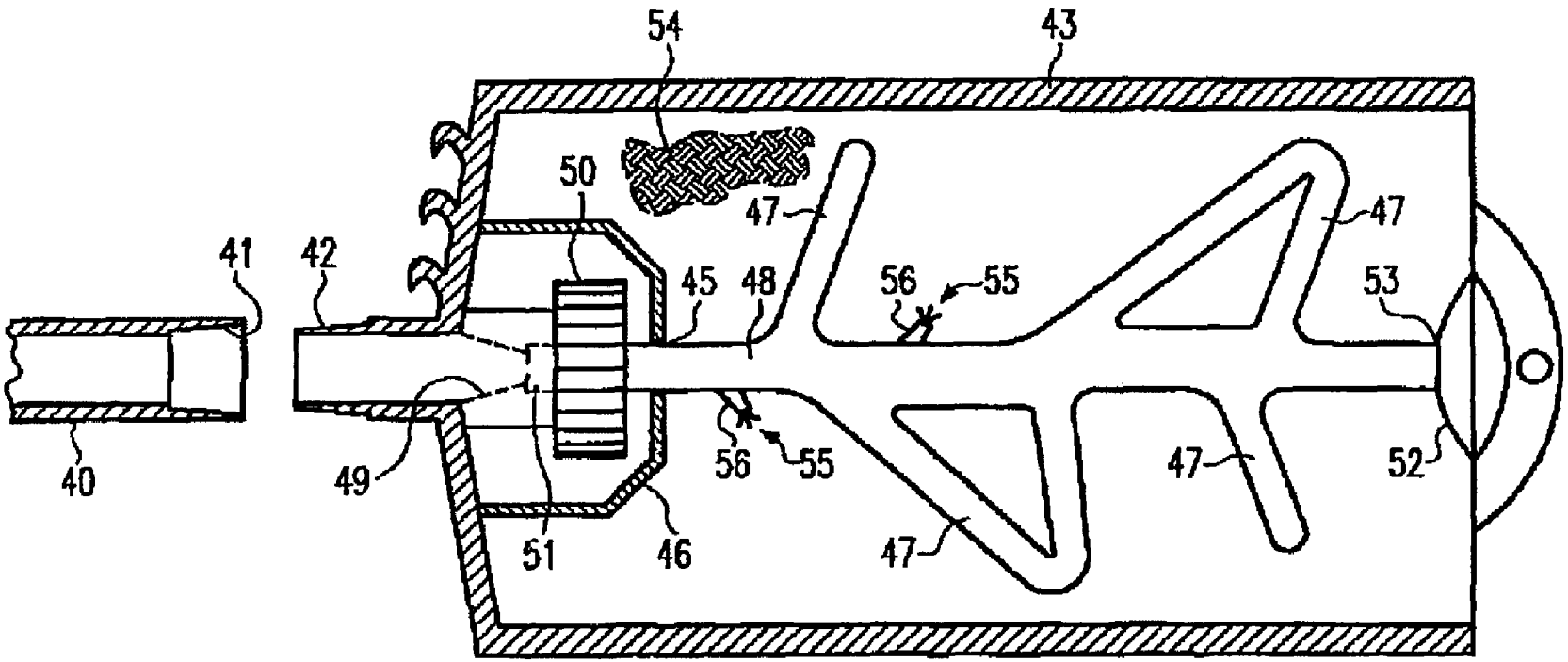
FIG. 4 is an enlarged sectional view of the round shell embodiment of the present invention apparatus using a single stem directional boring machine.

FIG. 4 shows the apparatus utilizing a dual reamer apparatus connected to a single stem directional boring machine drill string 40. Standard directional boring machines that use a single stem drill string 40 utilize threaded connections 41. The apparatus is connected to the drill string 40 using a threaded end 42. Torque provided to the drill string via mechanical power at the boring machine turns the exterior shell 43 of the apparatus. Ideally gears 50 (or a camshaft) in a planetary drive 46 ideally located in the interior of the apparatus convert the rotational torque provided by the revolving outer shell into usable energy to turn the interior mixing section 48. A sealed connection 45 prevents intrusion of the fluid 56 and soil 54 into the planetary drive 46. The interior section 48 can be gear so as to turn at various rotational speeds with respect to the outer section 43 and can be reversed with respect to the revolution of the outer section 43 if so desired. Various mixing wings are used to mix the soil 54 cut by the outer section 43 and the fluid 55 disbursed through nozzles 56 at various locations. Fluid is delivered via the drill string 40 and a connection that passes the fluid through the planetary drive 49 and 51. Ideally a mechanical swivel 53 and bearing assembly 52 can be used to reduce problems associated with torque and impact for the interior section 48, although the interior section could be cantilevered with the addition of a bearing assembly located near the planetary drive 46.

Figure 5:
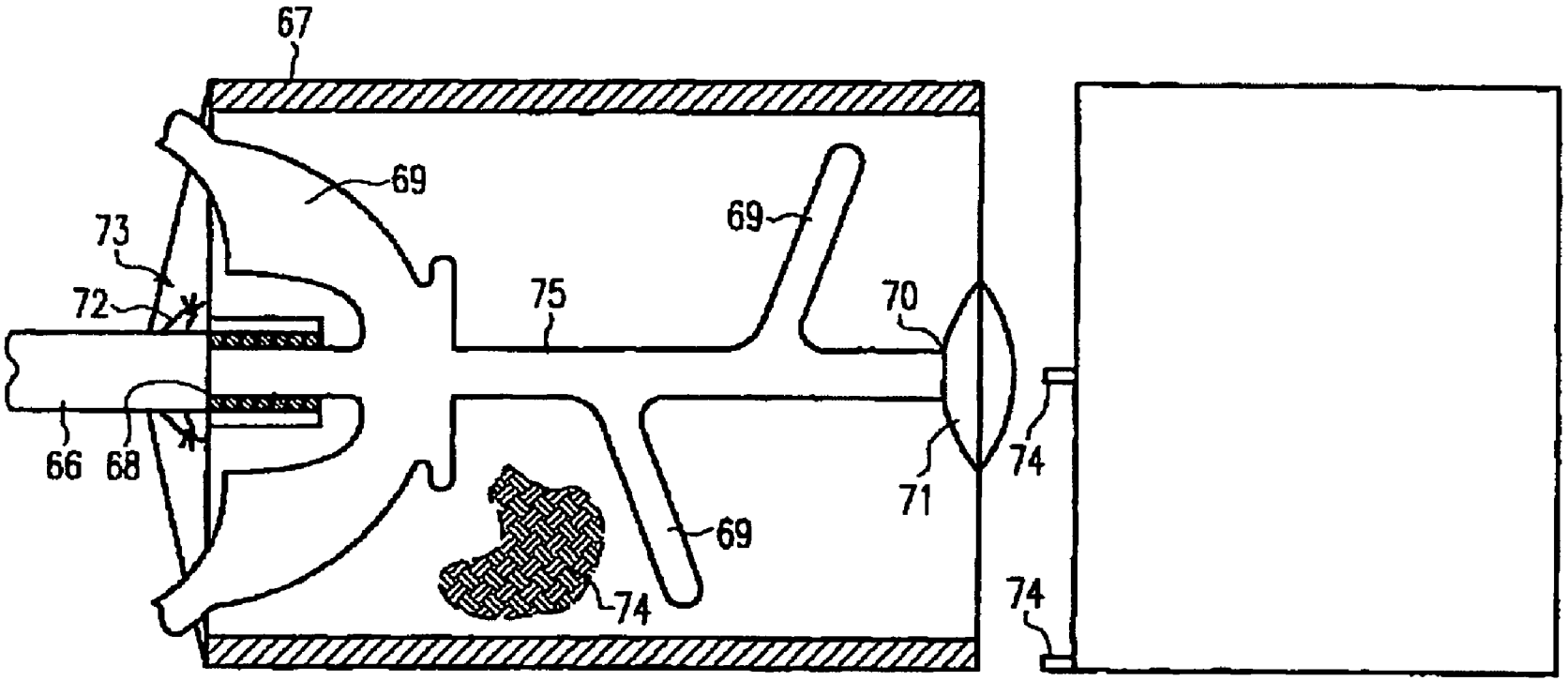
FIG. 5 is an enlarged sectional view of the polygonal shell embodiment of the present invention apparatus connected to a dual stem directional boring machine.

FIG. 5 provides a sectional side view and front view of the apparatus that can be used to create a polygonal (in this case a square) reamed hole. This view shows the apparatus connected to a dual stem directional boring machine drill string 66, although it may be attached to other drill strings with some modifications. The interior section of the device ideally rests on a bearing assembly 68 and is ultimately provided with torque via the drill string. Fluid 73 is forced down the drill string and out nozzles 72 at various locations. The outer shell 67 does not rotate and is kept in the desired position via the use of stabilizing wings 74 located at various positions on the exterior of the outer shell. The interior section is rotated and mixing/cutting wings 69 are used to cut and mix the soil. The configuration of the mixing/cutting wings may be varied based on anticipated soil types. The fluid 73 and soil 74 in the desired reamed path is mixed to a slurry for ease of installation of the desired conduit(s) or pipe(s). A bearing assembly 71 and swivel 70 at the rear of the apparatus should ideally be used to reduce impact and torque problems with the interior section.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

The invention claimed is:

1. A method of creating a reamed hole below the surface, the method comprising the steps of:

positioning a directional drilling machine on the surface, the directional drilling machine having a dual stem boring stem, the boring stem having concentric inner and outer stems;

connecting a reaming device using a dual reaming mechanism, said mechanism being driven by the dual stem boring stem, wherein the inner and outer stems are coupled, respectively, to an interior section and an exterior section of the reaming device;

pulling back the remaining apparatus thereby forming a reamed hole that is larger than the boring stem.

2. The method of claim 1 wherein the dual reaming mechanism is used to form a substantially non-round or irregularly shaped reamed hole larger than the drill.

3. The method of claim 1 wherein the interior section is rotated at a different rate than the exterior section.

4. The method of claim 1, wherein the reaming device is used to produce a substantially circular reamed area where dirt has been removed.

5. The method of claim 1, wherein the interior section of the dual reaming device is rotated in a clockwise rotation and the exterior section of the reaming device is rotated in a counterclockwise rotation.

6. The method of claim 1, wherein the interior section of the dual reaming device is rotated in a clockwise rotation and the exterior section of the reaming device is rotated in a counterclockwise rotation.

7. The method of claim 1, wherein the interior section of the dual reaming device is rotated in a clockwise or counterclockwise position and the exterior section of the reaming device is rotated in a clockwise or counterclockwise position.

8. A dual reaming apparatus comprising:

a dual stem boring stem device;

an exterior section comprising a hollow shell of predetermined cross-sectional shape, the exterior section having a portion for cutting or reaming sub-surface material and a first coupling member for coupling with an outer stem of the dual stem; and an interior section, disposed within the exterior section and having projections shaped for mixing cut or reamed material, the interior section including a second coupling member for coupling with an inner stem of the dual stem, wherein the interior section and the exterior section are rotated independently of one another in either a clockwise or counterclockwise direction such that they will turn in either direction regardless of the direction the other is turning.

9. The apparatus of claim 8 wherein the first coupling member comprises a threaded connection member.

10. The apparatus of claim 8 the second coupling member comprises a threaded connection member or a slotted connection member.

11. The apparatus of claim 8, wherein there are provided inside the exterior section one or more jets for ejection of fluid to assist in mixing of the reamed material.

12. A method of creating a substantially horizontal reamed hole below the surface, the method comprising the steps of:

positioning a directional drilling machine on the surface, the directional drilling machine having a dual stem boring stem, the boring stem having concentric inner and outer stems;

connecting a reaming device to the boring stem wherein the reaming device has a dual reaming mechanism with an interior section and an exterior section wherein the interior section is coupled to the inner stem and the exterior section is coupled to the outer stem;

pulling back the reaming apparatus thereby forming a reamed hole that is larger than the stem; and rotating the interior section of the dual reaming mechanism at a slower or faster revolution rate than the exterior section of the apparatus during the pulling back step.

13. A method according to claim 12, wherein the interior section of the dual reaming device is rotated in a clockwise rotation and the exterior section of the reaming device is rotated in a counterclockwise rotation.

14. A The method according to claim 12, wherein the interior section of the dual reaming device is rotated in a counterclockwise rotation and the exterior section of the reaming device is rotated in a clockwise rotation.

15. The method of claim 12, wherein the reaming device is used to produce a substantially circular reamed area where dirt has been removed.

16. An apparatus for creating a reamed hole below the surface, the apparatus comprising:

a dual stem boring stem device;

an exterior section comprising a hollow shell of predetermined cross-sectional shape, the exterior section having a portion for cutting or reaming sub-surface material and a first coupling member for coupling with an outer stem of the dual stem; and an interior section, disposed within the exterior section and having projections shaped for mixing, in use, cut or reamed material, the interior section including a second coupling member for coupling with an inner stem of the dual stem, wherein the exterior section and the interior section are turned independently of each other by the dual stem.

17. An apparatus according to claim 16 wherein the exterior section is arranged to substantially not rotate during the creation of a reamed hole.

18. An apparatus according to claim 17, wherein the exterior section is provided with at least one outside stabilizing wing to reduce rotation.

19. An apparatus according to claim 17, wherein the exterior section has a non-circular cross section.

20. An apparatus according to claim 16, wherein the exterior section has a substantially circular cross section.

21. An apparatus according to claim 16, wherein the exterior section and the interior section are both rotatable about the same axis.

* * * * *

UNITED STATES PATENT AND TRADEMARK OFFICE

CERTIFICATE OF CORRECTION

PATENT NO. : 7,389,829 B2
APPLICATION NO. : 10/517396
DATED : June 24, 2008
INVENTOR(S) : Theodore Roy Dimitroff It is certified that error appears in the above-identified patent and that said Letters Patent is hereby corrected as shown below:

Col. 5, claim 6: "clockwise" should be changed to "counterclockwise" and "counterclockwise" should be changed to "clockwise"

Col. 6, claim 9: insert --wherein-- after "8."

Col. 6, claim 14: the beginning of the claim reads "A The . . ." but should read "The . . ."

Signed and Sealed this

Second Day of December, 2008

JON W. DUDAS
*Director of the United States Patent and Trademark Office*

UNITED STATES PATENT AND TRADEMARK OFFICE

CERTIFICATE OF CORRECTION

PATENT NO. : 7,389,829 B2
APPLICATION NO. : 10/517396
DATED : June 24, 2008
INVENTOR(S) : Theodore Roy Dimitroff It is certified that error appears in the above-identified patent and that said Letters Patent is hereby corrected as shown below:

Col. 5, claim 6, lines 65 and 67: "clockwise" should be changed to "counterclockwise" and "counterclockwise" should be changed to "clockwise"

Col. 6, claim 9, line 21: insert --wherein-- after "8."

Col. 6, claim 14, line 49: the beginning of the claim reads "A The . . ." but should read "The . . ."

This certificate supersedes the Certificate of Correction issued December 2, 2008.

Signed and Sealed this

Twenty-third Day of December, 2008

JON W. DUDAS
*Director of the United States Patent and Trademark Office*